US008479420B2

(12) United States Patent
Moretti

(10) Patent No.: US 8,479,420 B2
(45) Date of Patent: Jul. 9, 2013

(54) CONTAINER WITH RELIEF DECORATIONS

(75) Inventor: Matteo Moretti, Crema (IT)

(73) Assignee: Lumson S.p.A., Capergnanica (IT)

( * ) Notice: Subject to any disclaimer, the term of this patent is extended or adjusted under 35 U.S.C. 154(b) by 603 days.

(21) Appl. No.: 12/699,436

(22) Filed: Feb. 3, 2010

(65) Prior Publication Data

US 2010/0193390 A1 Aug. 5, 2010

(30) Foreign Application Priority Data

Feb. 5, 2009 (IT) ..... MI2009A0148

(51) Int. Cl.
*G09F 1/00* (2006.01)

(52) U.S. Cl.
USPC ..... 40/310; 215/381

(58) Field of Classification Search
USPC ..... 40/310; 215/381, 382
See application file for complete search history.

(56) References Cited

U.S. PATENT DOCUMENTS

| | | | | |
|---|---|---|---|---|
| 4,824,787 | A * | 4/1989 | Serkes et al. | 435/299.2 |
| 7,051,890 | B2 * | 5/2006 | Onoda et al. | 215/383 |
| 7,182,214 | B2 * | 2/2007 | Darr et al. | 215/398 |
| 7,798,349 | B2 * | 9/2010 | Maczek et al. | 215/381 |
| 7,837,049 | B2 * | 11/2010 | Boukobza | 215/381 |
| 2003/0010744 | A1 | 1/2003 | Ma et al. | |
| 2004/0026355 | A1 | 2/2004 | Headen et al. | |
| 2004/0070836 | A1 | 4/2004 | Rosenthal | |
| 2007/0012650 | A1 * | 1/2007 | Eble | 215/382 |
| 2008/0093331 | A1 | 4/2008 | Roubal et al. | |
| 2010/0112263 | A1 * | 5/2010 | Lorence et al. | 428/41.8 |

FOREIGN PATENT DOCUMENTS

| | | | |
|---|---|---|---|
| EP | 0 742 153 | A1 | 11/1996 |
| EP | 1 772 385 | A1 | 4/2007 |
| EP | 1 947 016 | A2 | 7/2008 |
| GB | 2 237 000 | A | 4/1991 |
| WO | WO 2008/130987 | A1 | 10/2008 |

* cited by examiner

*Primary Examiner* — Casandra Davis
(74) *Attorney, Agent, or Firm* — Oblon, Spivak, McClelland, Maier & Neustadt, L.L.P.

(57) ABSTRACT

A container comprising a base and a top in which a mouth is provided, said base and said top being joined by at least one lateral wall, said lateral wall presenting at least one first region carrying a relief decoration and a second region intended to carry printing.

11 Claims, 2 Drawing Sheets

CONTAINER WITH RELIEF DECORATIONS

The present invention relates to a container with relief decorations. In particular, it relates to a container constructed of thermoplastic material.

Containers presenting relief decorations are known. These decorations are usually provided on the container bottom surface to indicate its contents, its use or the manufacturer.

Reliefs are also provided on the container lateral surface, in particular in the form of writings representing trademarks.

When the extent of these relief regions is small (less than 3%) there are no particular problems in labelling the container. However if the reliefs occupy a considerable area (greater than 3%) it is not possible to effectively label or print on the container.

US2003/010744, GB2237000 and US2004/026355 show containers with reliefs and regions intended for the fixing of a label.

An object of the present invention is to provide a container which even if relief decorated over a large surface area, it can be easily labeled or printed on, for example by silk-screen printing.

These and other objects are attained by a container with relief decorations according to the technical teachings of the accompanying claims.

Further characteristics and advantages of the invention will be apparent from the description of a preferred but non-exclusive embodiment of the container, illustrated by way of non-limiting example in the accompanying drawings, in which:

FIG. 1 is a side view of the container of the present invention; and

FIGS. 2, 3 and 4 are sections taken respectively on the lines 2-2, 3-3 and 4-4 of FIG. 1;

Figure 1:
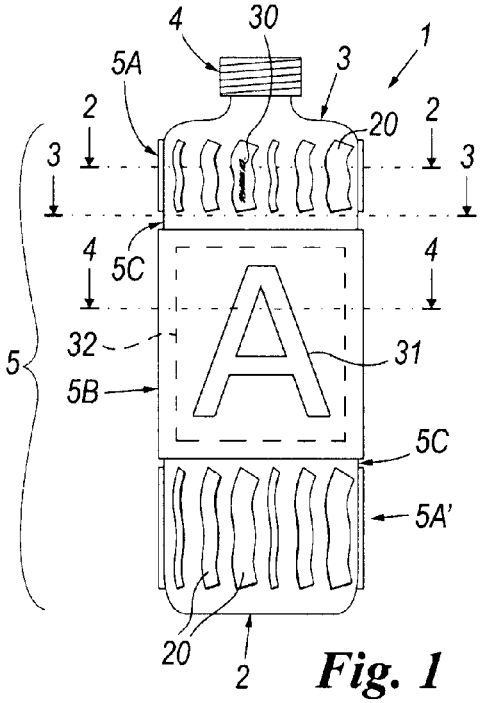
Figure 5:
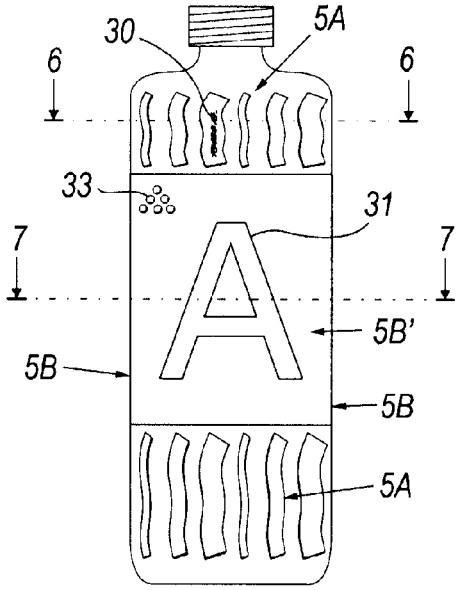
Figure 6:
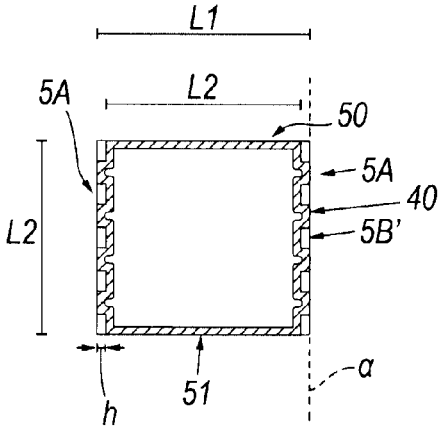
Figure 7:
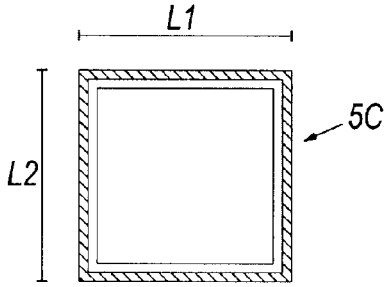

FIG. 5 shows an alternative embodiment of the container of FIG. 1, which is quadrangular in plan; and FIGS. 6 and 7 are sections taken on the lines 6-6 and 7-7 of FIG. 5.

With reference to said figures, these show a container 1 comprising a base 2 and a top 3 in which a threaded mouth 4 is provided.

The base 2 and top 3 are joined by a lateral wall 5.

The lateral wall 5 presents a first region 5A, 5A' carrying a relief decoration extending through a large portion (greater than 3% but preferably greater than 10% of the container outer surface) of the lateral wall.

Figure 2:
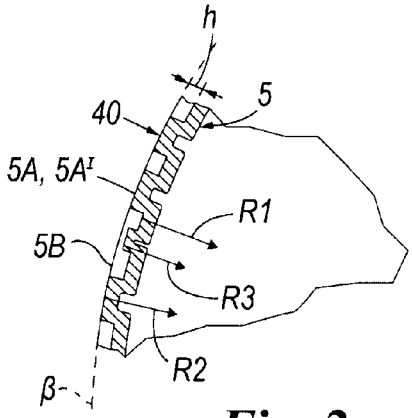

As can be seen in FIG. 2, the reliefs 20 are defined by the outer radius R2 of the bottle, while the recesses are defined by the outer (base) radius R1 of the bottle. In other words, the reliefs have a height h given by the difference R2−R1. Reliefs of lesser height are also present, defined by the outer radius R3.

Evidently in this case the reliefs 20 have been defined by radii in relation to a container of substantially circular cross-section, however the same discourse can be applied by analogy to a container of square, oval or any other shape, even having a cross-section which varies with its height, for example tapering upwards. In this case the reliefs are no longer defined by radii, but purely by their height from the ideal outer minor perimeter surface of the container, or by the distance of the plane containing the relief crests from the container axis.

The wall 5 presents a second region 5B intended to carry printing 31. The printing can be applied directly to the surface of the second region 5B by silk-screen printing, or this region can be dedicated to housing a printed label 32 (represented by a dashed line in FIG. 1) glued onto it in known manner.

Figure 4:
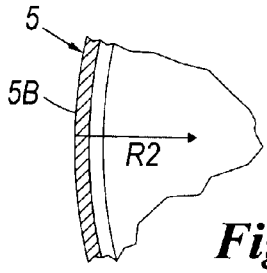
FIG. 4A shows a section taken in the same position as the section 4-4 of FIG. 1, but through a container formed in accordance with an alternative embodiment of the invention.
FIG. 4B shows a section taken in the same position as the section 4-4 of FIG. 1, but through a container formed in accordance with a further alternative embodiment of the invention.
Figure 4A:
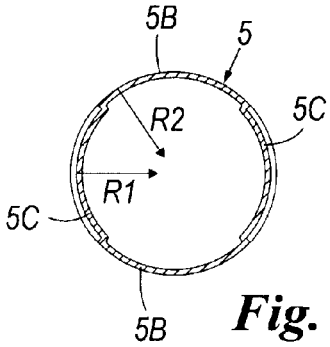
Figure 4B:
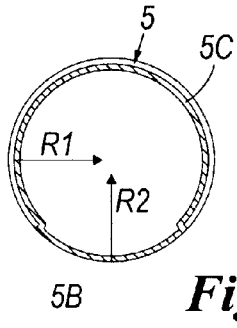

In the embodiment of FIG. 4, this second region 5B is in circular form, with outer radius R2 equal to the maximum radius of the reliefs of the first region 5A, with which they are therefore aligned (flush). In this manner, silk-screen printing or a label can be easily applied. Advantageously during the silk-screen printing of the second region 5B, printing 30 could also be applied to the maximum surface (or crest) of at least one relief of the first region 5A.

This would not be possible if that container region which is to carry printing has a lesser or greater height than the crests of the reliefs of the decorated region 5A.

Figure 3:
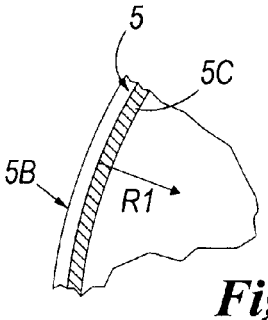

Finally a connection portion 5C is provided between the decorated region and that which is to carry printing. This region is shown in the sectional view of FIG. 3 and has an outer radius R1 equal to that of the most recessed portion of the reliefs of the decorated region 5A.

Advantageously the container is formed of thermoplastic polymer blow-moulded in a shell mould.

This thermoplastic polymer is preferably PE and/or PP and/or PET and/or PETG and/or PVC. However the container can also be made of other plastic or non-plastic materials, for example recyclable or biodegradable.

A different embodiment of the invention is shown in FIGS. 5, 6 and 7.

The decorated region is again indicated by 5A and for example is disposed only on two opposing faces of the container. The height h of the reliefs in this case is given by the difference L1−L2 divided by two and, as in the preceding cases, is advantageously between 1 and 9 tenths of a millimeter, but preferably between 1 and 3 tenths.

The other two lateral faces 50, 51 act as a relief-free region in which printing can be applied.

FIG. 7 shows a section taken on the sectional line 7-7 of FIG. 5. As can be clearly seen, the region 5B' between the two decorated regions presents a surface aligned (flush) with the maximum height (crest) of the reliefs provided in the decorated regions 5A.

The concepts of the aforedescribed circular and square based embodiments can easily be extended to different shapes such as upwardly tapered, or any other shape.

In addition to applying silk-screen printing to the container second region 5B (FIG. 1 or 5), some or all those surfaces defining the crests of the decoration provided in the first region 5A can be silk-screen printed, to give the container an even more elegant effect.

In a different embodiment, in addition to all the aforedescribed, the container can comprise reliefs carrying impressed symbols or letters for the blind, for example to indicate the type of product in the container or its capacity. These symbols or reliefs 33 can also be provided on the second or third region.

In a preferred embodiment of the invention the reliefs 20 have a flat (or cylindrical) surface that is on the same plane $\alpha$ (FIG. 5-7) or on the same cylindrical surface $\beta$ (FIG. 1-4, 4A, 4B) of the second region 5B.

The invention claimed is:

1. A container, comprising:

a base; and a top in which a mouth is provided, wherein said base and said top being joined by at least one lateral wall, said lateral wall presenting at least one first region carrying a relief decoration extending through a large portion of the lateral wall, and a second region carrying printing, said second region being aligned or flush with crests of said reliefs of the first region, wherein said first and second region are provided in distinct locations on the lateral wall, the reliefs having a flat or cylindrical surface so that a printing can be applied, and wherein said printing is formed by silk-screen printing on the surface of the first and/or second region.

2. A container as claimed in claim 1, wherein said first region has an area greater than 10% of the total surface of the container.

3. A container as claimed in claim 1, wherein the first region carrying a relief decoration is placed externally to the perimeter of the second region carrying a printing.

4. A container as claimed in claim 1, wherein at least one surface of the crests of at least one of said reliefs presents printing.

5. A container as claimed in claim 4, wherein said first region has an area greater than 3% of the total surface of the container.

6. A container as claimed in any one of claims 1-5, wherein the printing is provided on a label glued to said first and/or second region.

7. A container as claimed in any one of claims 1-5, wherein said first and second region have a height greater than a third container region in which neither decorations nor printing are present.

8. A container as claimed in any one of claims 1-5, wherein the height of said reliefs is between 1 and 9 tenths of a millimeter.

9. A container as claimed in claim 8, wherein the container is formed by blow-moulding a thermoplastic polymer in a mould, said thermoplastic polymer comprising PE and/or PP and/or PET and/or PETG and/or PVC.

10. A container as claimed in any one of claims 1-5, wherein on its surface, reliefs are provided representing symbols or letters for the blind.

11. A container as claimed in claim 8, wherein the height of said reliefs is between 1 and 3 tenths of a millimeter.

* * * * *